US005417815A

United States Patent [19]

Robinson et al.

[11] Patent Number: 5,417,815

[45] Date of Patent: May 23, 1995

[54] LIQUID SURFACE SKIMMER APPARATUS FOR MOLTEN LITHIUM AND METHOD

[75] Inventors: Samuel C. Robinson, Knoxville; Roy E. Pollard, Maryville; William F. Thompson, Oak Ridge, all of Tenn.; Marshall W. Stark, Gastonia; Robert T. Currin, Jr., Salisbury, both of N.C.

[73] Assignee: Martin Marietta Energy Systems, Inc., Oak Ridge, Tenn.

[21] Appl. No.: 154,912

[22] Filed: Feb. 7, 1994

[51] Int. Cl.[6] ..... C25C 3/02; C25C 7/00

[52] U.S. Cl. ..... 204/68; 204/245; 210/776; 266/228

[58] Field of Search ..... 204/245, 68; 210/776; 266/228

[56] References Cited

U.S. PATENT DOCUMENTS

| | | | |
|---|---|---|---|
| 3,800,951 | 4/1974 | Mourlon et al. | 210/776 X |
| 4,415,144 | 11/1983 | Klotz et al. | 266/228 |
| 4,740,279 | 4/1988 | Müller et al. | 204/245 X |
| 4,956,100 | 9/1990 | Mikkleson | 210/776 |

*Primary Examiner*—Donald R. Valentine
*Attorney, Agent, or Firm*—Bruce E. Harang; James K. Davis; Vincent A. Branton

[57] ABSTRACT

This invention relates to an apparatus for separating two fluids having different specific gravities. The invention also relates to a method for using the separating apparatus of the present invention. This invention particularly relates to the skimming of molten lithium metal from the surface of a fused salt electrolyte in the electrolytic production of lithium metal from a mixed fused salt.

6 Claims, 1 Drawing Sheet

LIQUID SURFACE SKIMMER APPARATUS FOR MOLTEN LITHIUM AND METHOD

BACKGROUND OF THE INVENTION

1. Field of the Invention

This invention relates to an apparatus and method of producing high purity lithium metal and the like by fused mixed salt electrolysis. More particularly this invention relates to a skimmer apparatus and method of use which allows for the efficient, economical and safe separation of the molten lithium metal and the like from the molten electrolyte.

2. Description of the Related Art

In commercial practice, lithium metal is produced by the electrolysis of a molten mixture of lithium chloride and other metal chlorides which reduce the melting point of lithium chloride. Suitable electrolytic cells have no diaphragm. Such cells are made of steel, a steel cathode, a graphite anode and have no internal lining. The molten lithium metal accumulates on the surface of the molten salts and is skimmed from said surface by means of a skimming ladle or may be withdrawn by elevators. As chlorine gas is evolved it is withdrawn from the cell. The liquid metal may be oxidized and nitrided by exposure to air. Published European Patent Publication No. 107 521 discloses a process for the continuous production of lithium metal by an electrolysis of lithium chloride contained in a molten salt mixture an electrolytic cell comprising a cylindrical steel cathode, which has been inserted into the bottom of the cell, and a graphite anode, which is immersed into the molten material in the cell. In that known process, the molten salt mixture which contains lithium metal is withdrawn from the cell and the lithium metal is separated outside the cell. Because chlorine gas is evolved and the end of the cathode is formed like a venturi tube, a natural circulation is imparted to the molten material. A further reaction of lithium metal in the molten mixture is to be avoided.

Impurities of whatever kind are highly undesirable in the lithium metal if it is to be used in nuclear technology in the production of alloys and in lithium batteries.

For this reason it is known from U.S. Pat. No. 3,962,064 issued June 1976 to Brut et al in the production of high purity lithium metal to perform the fused-salt electrolysis in an electrolytic cell which has no diaphragm and in which the lithium metal which has separated is collected on the surface of the electrolyte and the electrolyte level is raised so that the metal is forced out of the cell through a system of overflows and is conducted to a receiver. The receiver contains a protective gas atmosphere, in which the liquid lithium metal having a purity of 99.9% is cast to form ingots. That known apparatus has the disadvantage that the equipment is expensive and that air is used in the known process as a pressure fluid for raising the level of the electrolyte (and of the lithium metal). Besides, the chlorine gas which is evolved is diluted with a large volume of air and is blown out to the cell together with this volume of air. This has the result that oxygen or air is inherently introduced into the system as an impurity, which is undesirable. Similarly, U.S. Pat. No. 4,724,055 issued Feb. 9, 1988 to Le Roux et al discloses the production of lithium metal using a diaphragmless electrolytic cell. This cell utilizes the chlorine gas produced to circulate the molten electrolyte and the further maintains an electrolyte temperature of less than 400° C., and a chlorine gas temperature of less than 300° C. to help prevent corrosion of the electrolytic cell container by the chlorine gas.

U.S. Pat. No. 4,455,202 issued Jun. 19, 1984 to Sintim-Damoa et al discloses a method of preventing chlorine gas production during lithium metal production in an electrolytic cell by using only lithium oxide instead of lithium chloride as a feed stock and by using a liquid metal cathode into which the metal lithium is absorbed. The liquid metal of the cathode containing the liquid metal lithium is then further processed to separate the lithium metal. This process has the commercial disadvantage of requiring costly preparation of lithium oxide from native lithium containing ores and the additional step of removing the lithium metal from the liquid metal of the cathode.

Another method of producing lithium metal by fused-salt electrolysis is disclosed in U.S. Pat. No. 4,740,279 issued Apr. 26, 1988 to Müller et al. In this reference the lithium metal is produced in a diaphragmless electrolytic cell in which the molten lithium metal is collected from the surface of the electrolyte by an annular trough and siphoned via a pipe to a separating chamber which communicates with the electrolytic cell and is sealed from the chlorine gas atmosphere in the electrolytic cell. An inert atmosphere is required to protect the lithium metal from reacting with air or chlorine.

OBJECTS AND SUMMARY OF THE INVENTION

One object of the present invention is to provide a safe, economical method of removing the molten lithium metal and the like from an electrolytic cell.

Another object of the present invention is to provide an efficient means of separating the molten electrolyte from the molten lithium metal and the like produced in a fused salt electrolytic cell.

Yet another object of the present invention is to provide a molten metal skimmer apparatus and method which may be used in fused salt electrolytic cells of known design.

Still another object of the present invention is to provide an apparatus for separating any two fluids having different specific gravities and which are not miscible.

Accordingly, one form of the present invention relates to an apparatus for skimming molten metal produced in a fused salt electrolytic cell comprising: a draft tube having an upper end located just below the surface of the molten salt electrolyte and a lower end connected to by a connecting means, and located within; an open bottom collection ring; a drive shaft and at least one propeller attached thereto disposed within said draft tube, said drive shaft extending upwardly out of said draft tube and connected by a connecting means to a drive means, said drive shaft and at least one propeller means; a withdrawal tube connected by a connection means to, and having a lower end located in, said collection ring and having an upper end connected by a connection means to a collection pipe; a collection pipe having a first end connected by a connection means to said withdrawal tube and a second end connected by a connection means to a collection reservoir; and a collection reservoir; further characterized in that the flow created by rotating said drive shaft having at least one propeller means draws the molten metal with some molten electrolyte downwardly into said draft tube and into said collection ring, the electrolyte passes out of the draft tube and out of the open bottom of the collection ring, returning to the electrolytic cell, the molten metal, being less dense than the molten electrolyte, floats upwardly and collects in the collection ring, is forced upwardly through the withdrawal tube, into the collection pipe and into the collection reservoir.

Another form of the invention relates to an apparatus as disclosed hereinabove wherein, said skimmed molten metal is substantially pure lithium metal.

Yet another form of the invention relates to a method of skimming molten metal from the surface of molten electrolyte produced in a fused salt electrolytic cell comprising: providing a draft tube having an upper end located just below the surface of the molten salt electrolyte within the electrolytic cell, a lower end connected to an open bottom collection ring, and having disposed within said draft tube a drive shaft and at least one propeller attached thereto; drawing molten metal and some molten electrolyte into said draft tubes upper end and downwardly into and through said open bottom collection ring by the flow created by the rotation of the at least one propeller within said draft tube; providing a withdrawal tube having a lower end located within said open bottom collection ring and having an upper end connected to a first end of a collection pipe, the second end of the collection pipe being connected to a collection reservoir; separating said molten metal from said molten electrolyte by way of density differences and moving said molten metal upwardly into said withdrawal tube; and moving the molten metal into a collection reservoir by means of a collection pipe communicating between the upper end of said withdrawal tube and said collection reservoir.

Still another form of the invention relates to a method as disclosed hereinabove wherein, said molten metal is substantially pure molten lithium metal.

Yet still another form of the present invention relates to an apparatus for separating two fluids having substantially different specific gravities and which are not miscible comprising: a draft tube having an upper end located just below the surface of the two fluids and a lower end connected to by a connecting means, and located within; an open bottom collection ring; a drive shaft and at least one propeller attached thereto disposed within said draft tube, said drive shaft extending upwardly out of said draft tube and connected by a connecting means to a drive means, said drive shaft and at lease one propeller means; a withdrawal tube connected by a connection means to, and having a lower end located in, said collection ring and having an upper end connected by a connection means to a collection pipe; a collection pipe having a first end connected by a connection means to said withdrawal tube and a second end connected by a connection means to a collection reservoir; and a collection reservoir; further characterized in that the flow created by rotating said drive shaft having at least one propeller means draws the two fluids downwardly into said draft tube and into said collection ring, the higher specific gravity fluid passes out of the draft tube and out of the open bottom of the collection ring, returning to the fluid container, the lower specific gravity fluid, being less dense, floats upwardly and collects in the collection ring, is forced upwardly through the withdrawal tube, into the collection pipe and into the collection reservoir.

And another form of the present invention relates to a method of separating two fluids having substantially different specific gravities and which are not miscible comprising: providing a draft tube having an upper end located just below the surface of the two fluids within a fluid container, a lower end connected to an open bottom collection ring, and having disposed within said draft tube a drive shaft and at least one propeller attached thereto; drawing the two fluids into said draft tubes upper end and downwardly into and through said open bottom collection ring by the flow created by the rotation of the at least one propeller within said draft tube; providing a withdrawal tube having a lower end located within said open bottom collection ring and having an upper end connected to a first end of a collection pipe, the second end of the collection pipe being connected to a collection reservoir; separating the lower specific gravity fluid from the higher specific gravity fluid by way of density differences and moving said lower specific gravity fluid upwardly into said withdrawal tube; and moving the lower specific gravity fluid into a collection reservoir by means of a collection pipe communicating between the upper end of said withdrawal tube and said collection reservoir.

Preferred forms of the invention, as well as other embodiments, objects, features and advantages of this invention, will be apparent from the following detailed description which is to be read in connection with the accompanying drawings.

BRIEF DESCRIPTION OF THE DRAWINGS

In the dryings which are appended hereto and make a part of this disclosure.

DESCRIPTION OF THE PREFERRED EMBODIMENTS OF THE INVENTION

Figure 1:
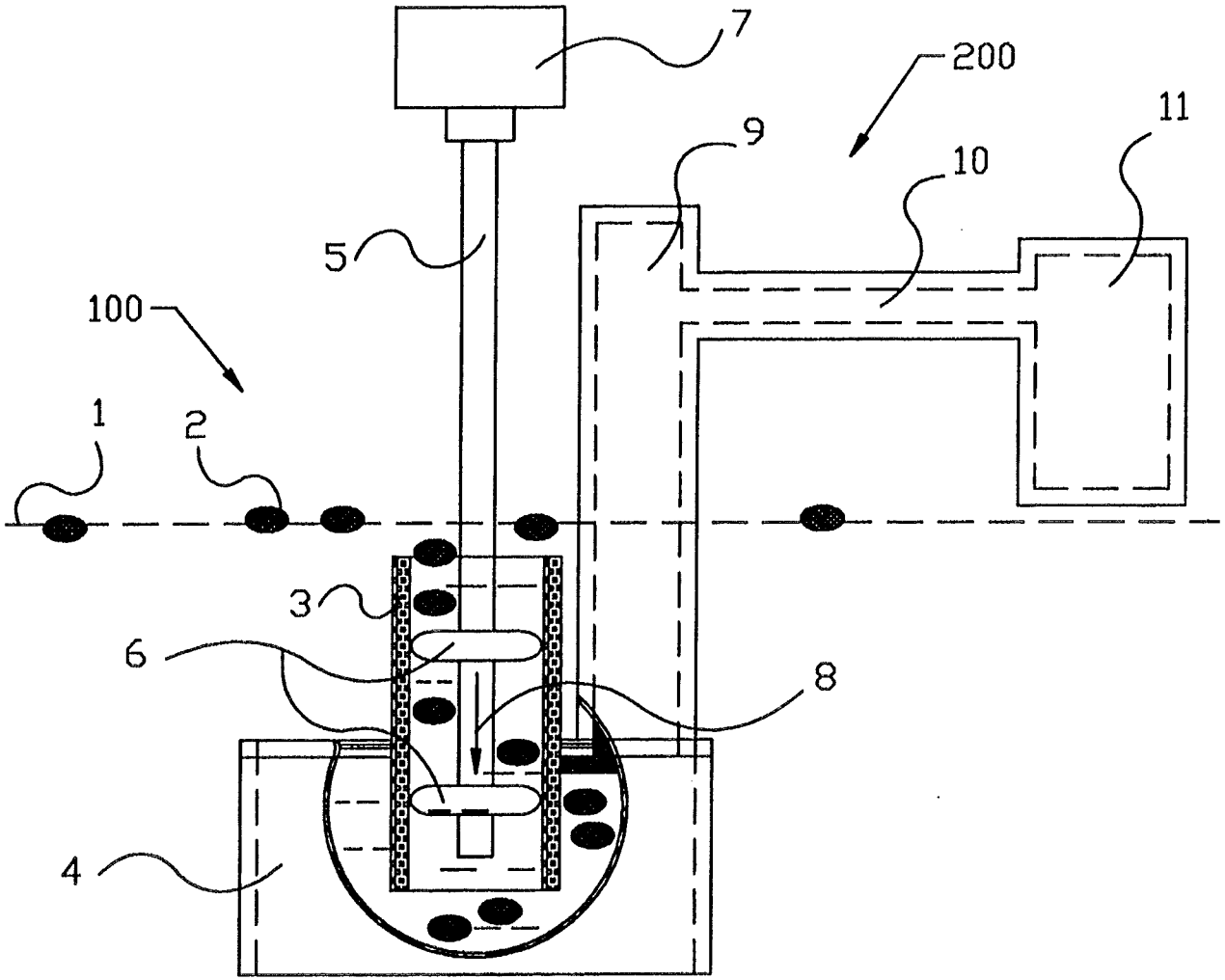
FIG. 1 is a schematic with partial cut away view of the apparatus of the present invention.

The present invention will be better understood from the specification taken in conjunction with the accompanying drawings in which like reference numerals refer to like parts.

Shown in FIG. 1 is a representation of part of an electrolytic cell 100 having molten metal lithium 2 floating on the surface of molten salt electrolyte 1 contained within the electrolytic cell 100. Partially submerged within the molten salt electrolyte 1 is the apparatus of the present invention 200 comprising a draft tube 3, having its upper end located just below the surface of the molten salt electrolyte 1, and its lower end connected to, and located within, open bottom collection ring 4 and having drive shaft 5 and at least one propeller 6 disposed within draft tube 3 and shaft 5 extending upwardly out of the draft tube 3 and connected to a drive motor 7 (not shown) located above the electrolytic cell 100. Rotation of the shaft 5 and propellers 6 by drive motor 7 (not shown) causes molten salt electrolyte 1 and molten lithium metal 2 to be drawn downwardly into the draft tube 3 and thereby into the collection ring 4 as is indicated by the arrow 8. The flow created by the movement of the propellers 6 forces the molten salt electrolyte 1 out of the bottom of the draft tube 3, out of the open bottom of the collection ring 4 and returns the electrolyte to the operating electrolytic cell. The molten lithium metal 2 having a lower specific gravity than the molten salt electrolyte 1 is supported by the molten salt electrolyte and is forced upwardly into withdrawal tube 9, into collection pipe 10 and into collection reservoir 11 where the molten metal lithium 2 is collected and allowed to cool. The now separated molten lithium metal 2 is further processed by means well known in the art (not shown). It is to be appreciated that the turbulent action caused by the propeller 6 helps to produce relatively small globules of the molten lithium metal 2 which improves the cleansing action of the molten salt electrolyte 1 on the molten lithium metal 2 and thereby produces substantially pure lithium metal. It is to be further appreciated that the apparatus of the present invention is sealed and protected from the atmosphere by means well known in the art.

It is also to be appreciated that the electrical, mechanical and control mechanisms to operate the electrolytic cell 100, the drive motor 7 are well known in the art and need no further description here.

In a process for producing lithium metal by the electrolysis of fused mixed salts (hereinafter "molten electrolyte"), for example, comprising electrolyzing molten electrolyte consisting of lithium chloride and potassium chloride in a diaphragmless electrolytic cell, withdrawing molten lithium metal from the cell to a receiver and cooling the lithium metal which has been withdrawn, we can accomplish this object in that the molten lithium metal rises to the surface of the molten electrolyte is collected in a collection ring located below the surface of the molten electrolyte and into which the lithium metal and molten electrolyte are drawn by the action of at least one propeller in a draft tube having an upper end located a little below the level of the surface of the molten electrolyte and having a lower end located within the collection ring. The electrolyte is circulated through the collection ring and returned to the electrolytic cell. The substantially pure molten lithium metal is removed from the collection ring by way of a withdrawal tube. The lithium metal being drawn into a collection reservoir by way of a collection tube. The lithium metal is stored for cooling and further processing. The substantially pure lithium metal which has been discharged into the collection reservoir is processed further in known manner, for instance, is cast to form ingots. The electrolyte is circulated in the electrolytic cell and is recycled from the collection ring to the electrolytic cell. Chlorine gas evolved at the anode is sucked from the cell over the molten material and is recovered as chlorine gas or in the form of salts. The chlorine gas stream is suitably sucked through an absorber, which is also supplied with a lithium hydroxide slurry and this slurry is also treated with ammonia as a reducing agent so that the reaction $$6LiOH+3C_2+2NH_3 \rightarrow 6\ LiCl+N_2+6H_2O$$

is performed. The lithium chloride thus recovered is reused as a raw material for the electrolysis.

Suitable electrolytic cells which may be used with the present invention include any of the molten electrolyte electrolytic cells known in the art. The only requirement is that the cell has the necessary size to incorporate the skimmer apparatus within it. It is to be further understood that the components, equipment, materials, and controls necessary to operate the electrolytic cell, and the present invention are well known in the art and need no further mention here. Suitable materials for use in the apparatus of the present invention include, for example, 304L stainless steel, Hastelloy and Inconel 625.

A suitable electrolyte for use with the present invention for producing lithium metal consists, for example, of a eutectic salt mixture of about 50% by weight lithium chloride and about 50% by weight potassium chloride. The operating temperature is about 400° C., and the current density is about 5,000 to 10,000 amperes per $m^2$, preferably 6,000 amperes per $m^2$. The cell voltage is about 6.2 to 9.2 volts. The current efficiency is in excess of 90%.

The advantages afforded by the apparatus and process in accordance with the invention are seen in that high-purity lithium metal and the like can be produce in an economical manner in a structurally simple and inexpensive apparatus which also eliminates the requirement of worker exposure to chlorine gas, fires and explosions. The present invention has the additional advantage of not requiring an additional separating step to separate and return the molten electrolyte to the electrolytic cell from the molten lithium metal. The molten electrolyte in effect never leaves the electrolytic cell while simultaneously producing substantially pure lithium metal without further extensive processing.

Although the illustrative embodiments of the present invention have been described herein with reference to the accompanying drawings it is to be understood that the invention is not limited to those precise embodiments, and that various other changes and modifications may be effected therein by one skilled in the art without departing from the scope or spirit of the invention.

What is claimed is: pure lithium metal.

1. A method of skimming molten metal from the surface of molten electrolyte produced in a fused salt electrolytic cell comprising:

a) providing a draft tube having an upper end located just below the surface of the molten salt electrolyte within the electrolytic cell, a lower end connected to an open bottom collection ring, and having disposed within said draft tube a drive shaft and at least one propeller attached thereto;

b) drawing molten metal and some molten electrolyte into said draft tubes upper end and downwardly into and through said open bottom collection ring by the flow created by the rotation of the at least one propeller within said draft tube;

c) providing a withdrawal tube having a lower end located within said open bottom collection ring and having an upper end connected to a first end of a collection pipe, the second end of the collection pipe being connected to a collection reservoir;

d) separating said molten metal from said molten electrolyte by way of density differences and moving said molten metal upwardly into said withdrawal tube; and e) moving the molten metal into a collection reservoir by means of a collection pipe communicating between the upper end of said withdrawal tube and said collection reservoir.

2. The method as claimed in claim 1 wherein, said molten metal is substantially pure molten lithium metal.

3. A method of separating two fluids having substantially different specific gravities and which are not miscible comprising:

a) providing a draft tube having an upper end located just below the surface of the two fluids within a fluid container, a lower end connected to an open bottom collection ring, and having disposed within said draft tube a drive shaft and at least one propeller attached thereto;

b) drawing the two fluids into said draft tubo's upper end and downwardly into and through said open bottom collection ring by the flow created by the rotation of the at least one propeller within said draft tube;

c) providing a withdrawal tube having a lower end located within said open bottom collection ring and ha,ting an upper end connected to a first end of a collection pipe, the second end of the collection pipe being connected to a collection reservoir;

d) separating the lower specific gravity fluid from the higher specific gravity fluid by way of density differences and moving said lower specific gravity fluid upwardly into said withdrawal tube; and e) moving the lower specific gravity fluid into a collection reservoir by means of a collection pipe communicating between the upper end of said withdrawal tube and said collection reservoir.

4. An apparatus for skimming molten metal produced in a fused salt electrolytic cell comprising:

a) an open bottom collection ring;

b) a draft tube having an upper end located just below the surface of the molten salt electrolyte and a lower end connected to, and located within, the top of said open bottom collection ring, by a connecting means;

c) a drive shaft and at least one propeller attached thereto disposed within said draft tube, said drive shaft extending upwardly out of said draft tube and connected by a connecting means to a drive means, said drive shaft and at lease one propeller means;

d) a withdrawal tube connected by a connection means to, and having a lower end located in, said collection ring and having an upper end connected by a connection means to a collection pipe;

e) a collection pipe having a first end connected by a connection means to said withdrawal tube and a second end connected by a connection means to a collection reservoir; and f) a collection reservoir;

further characterized in that a flow is created by rotating said drive shaft having at least one propeller means thereby drawing the molten metal with some molten electrolyte downwardly into said draft tube and into said collection ring, the electrolyte passes out of the draft tube and out of the open bottom of the collection ring, returning to the electrolytic cell, the molten metal, being less dense than the molten electrolyte, floats upwardly and collects in the collection ring, is forced upwardly through the withdrawal tube, into the collection pipe and into the collection reservoir.

5. An apparatus as claimed in claim 4 wherein, said fused salt electrolytic cell is a lithium chloride/potassium chloride fused salt diaphragmless electrolytic cell.

6. An apparatus for separating two fluids having substantially different specific gravities and which are not miscible comprising:

a) an open bottom collection ring;

b) a draft tube having an upper end located just below the surface of the molten salt electrolyte and a lower end connected to, and located within, the top of said open bottom collection ring, by a connecting means;

c) a drive shaft and at least one propeller attached thereto disposed within said draft tube, said drive shaft extending upwardly out of said draft tube and connected by a connecting means to a drive means, said drive shaft and at lease one propeller means;

d) a withdrawal tube connected by a connection means to, and having a lower end located in, said collection ring and having an upper end connected by a connection means to a collection pipe;

e) a collection pipe having a first end connected by a connection means to said withdrawal tube and a second end connected by a connection means to a collection reservoir; and f) a collection reservoir;

further characterized in that a flow is created by rotating said drive shaft having at least one propeller means thereby drawing the molten metal with some molten electrolyte downwardly into said draft tube and into said collection ring, the electrolyte passes out of the draft tube and out of the open bottom of the collection ring, returning to the electrolytic cell, the molten metal, being less dense than the molten electrolyte, floats upwardly and collects in the collection ring, is forced upwardly through the withdrawal tube, into the collection pipe and into the collection reservoir.

* * * * *